US005165966A

United States Patent [19]

Adams

[11] Patent Number: 5,165,966

[45] Date of Patent: Nov. 24, 1992

[54] PROCESS FOR PAINTING SNOW

[76] Inventor: Theodore P. Adams, 4202 Sunnyside Rd., Edina, Minn. 55435

[21] Appl. No.: 669,896

[22] Filed: Mar. 15, 1991

[51] Int. Cl.[5] ..... B05D 5/00; B05D 7/00; B05D 1/02

[52] U.S. Cl. ..... 427/256; 434/84

[58] Field of Search ..... 427/256; 434/84

[56] References Cited

U.S. PATENT DOCUMENTS 3,841,019 10/1974 Lorenzo ..... 446/100

4,364,994 12/1982 Fogelberg ..... 427/421 X

OTHER PUBLICATIONS

Technical brochure on "Sno-Paint" ®, St. Paul, MN, Decko Products, undated, two pages.

*Primary Examiner*—Evan Lawrence

*Attorney, Agent, or Firm*—Hugh D. Jaeger

[57] ABSTRACT

A process of allowing one to paint or draw on snow whereby a coloring agent, such as food coloring, is mixed with a gelling agent, such as household gelatin, and applied with a spray or squirt gun. When the gel solution contacts the cold snow, the gel solution quickly sets up and is prevented from dissipating as snow undergoes partial melting. When snow melts, the gel liquifies and disappears with runoff water.

12 Claims, 2 Drawing Sheets

PROCESS FOR PAINTING SNOW

BACKGROUND OF THE INVENTION

1. Field of the Invention

The present invention is for illustrating or coloring snow or ice, and more particularly, pertains to coloring or painting snow or ice with a biodegradable solution.

2. Description of the Prior Art

Using colored water for this purpose does not work because the water melts the snow and runs. In addition, water (ice) melts at too low a temperature. If colored water is used to color snow it runs before freezing and is very difficult to control. It also runs quickly under partial melting conditions. Other forms of paints may not totally melt and disappear upon spring thawing and may be toxic to children who might eat snow containing the coloring agent. The materials used in this invention are edible and otherwise environmentally harmless.

SUMMARY OF THE INVENTION

The general purpose of the present invention is to provide a process of allowing a person to paint or draw on snow. A coloring agent, such as food coloring, is mixed with a gelling agent, such as household gelatin, and applied via a spray or squirt gun. When the gel solution contacts the cold snow, the gel solution quickly sets up (gels), and is prevented from dissipating as snow undergoes partial melting. When snow melts, the gel liquifies and disappears with the runoff water.

According to one embodiment of the present invention, a process is provided including the new use of animal protein based gelatine mixed with water and food coloring to be sprayed on snow or other cold surfaces to create pictorial or geometrical images. The gelatin based coloring gels very quickly on contact with snow and remains in a gel state until temperatures exceed 50–70 degrees. The material can be stored in a dry state (powder) and mixed with water just before use. A common spray bottle with an adjustable nozzle, such as those used for weed sprays works well as an applicator for toy applications (graffiti, etc.)

Significant aspects and features of the present invention include a snow paint which is biodegradable and environmentally safe, is edible and totally nontoxic, is of a higher melting temperature than snow, but disintegrates in normal spring temperatures, and leaves no residues to clean up in spring or summer.

Having thus described the embodiments of the present invention, it is a principal object hereof to provide a process for painting snow or cold surfaces with a colored gelatin based solution.

One object of the present invention is a process of mixing a coloring agent (snow color) with an organic biodegradable non-toxic gelatin (snow gel), such as animal-based gelatin, to paint the snow or any other cold surface (snow paint).

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. illustrates an applicator for a process; and,

FIG. illustrates the process of the present invention.

DESCRIPTION OF THE PREFERRED EMBODIMENTS

The mixture of gelatin, food coloring and water is very forgiving with a wide range of acceptable variations. Roughly ¼ ounce of gelatin mixed with five drops of concentrated food coloring and one cup of water works well. The recipe could be varied by 100% in any variation and still works well. The material sets up faster with higher concentrations of gelatin, but could cause problems with the spray nozzle if the concentration is too high. The material could be applied by a hand-held spray applicator for toy applications or by a motorized pump for commercial applications, such as the Winter Carnival in St. Paul.

In the toy applications, the dry gelatin powder and food coloring could be packaged in individual packets containing the proper amount of gelatin to mix with one bottle full of water that comes with the spray applicator. Each packet would contain a mixture of a different color. In the commercial application, the colored gelatin mix could be sold in bulk form. It could be applied by the same type of equipment used for spraying insecticides and herbicide. One type of dry gelatin is Knox gelatin.

MODE OF OPERATION

Figure 1:
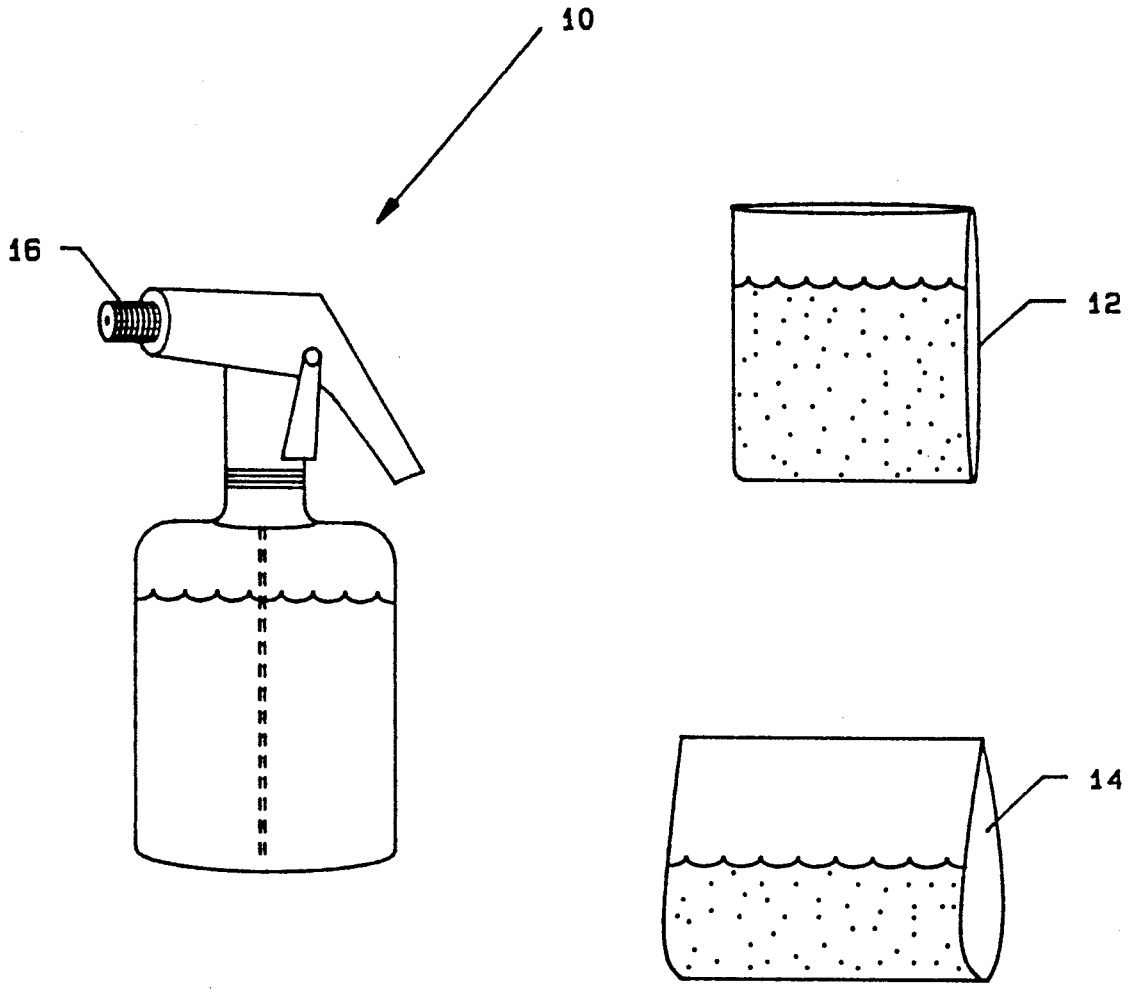

In FIG. 1, a container 10 is filled with warm water, and a gelatin packet 12 and an optional dye packet 14 are added. The container is vigorously shaken for about one minute to dissolve the gel and mix the gel and optional dye. A nozzle 16 on the container 10 is adjusted for misting for overall background coloring or jetting for narrowly defined images. The gel and coloring agent can be contained in a plastic lined paper packet or other suitable container. The gel, coloring agent and spray bottle can be packaged and sold individually or as a group.

Figure 2:
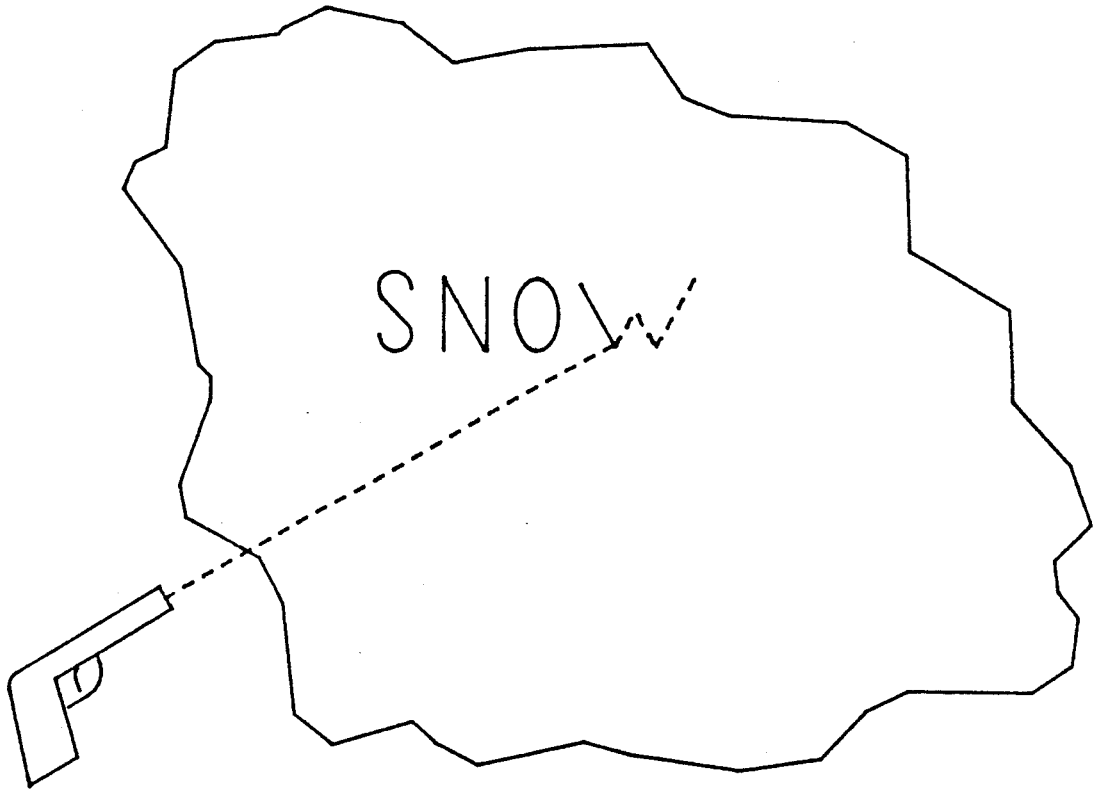

In FIG. 2, the use of a combination of a gelling agent, coloring agent, and water is for painting or coloring snow or other cold surfaces. The gelling agent is natural or organic gelatin, and the coloring agent is food coloring dye. The gelling agent can also be a synthetic organic or inorganic gelling chemical. The painting solution is used in conjunction with a spray apparatus to coat snow or other cold surfaces. The spray apparatus has an adjustable nozzle to control the definition of the spray. The system is used as a toy for painting graphics or images on snow. The system is used in commercial applications, such as marking ski trails, painting snow sculptures, etc.

Various modifications can be made to the present invention without departing from the apparent scope hereof.

I claim:

1. The process comprising the steps of:

a. mixing a gelling agent, coloring agent and water in an aqueous solution for painting or coloring snow or other cold surfaces, said solution gelling upon contact with said cold surfaces;

b. filing a sprayer apparatus with said solution;

c. spraying said solution on snow or ice to form a coating.

2. The process of claim 1 wherein the gelling agent is natural organic gelatin and the coloring agent is food coloring dye.

3. The process of claim 1 wherein the gelling agent is a synthetic organic or inorganic gelling chemical.

4. The process of claim 1 wherein the spray apparatus has an adjustable nozzle to control the definition of the spray.

5. The process of claim 1 wherein the process is used to coat graffiti or images on snow.

6. The process of claim 1 wherein the process is used to coat ski trails, and painting snow sculptures.

7. Process for painting or coloring snow, ice or other cold surface comprising the steps of:

a. mixing water, a gelling agent and a coloring agent in an aqueous solution in a container of an applicator, said solution gelling on contact with said cold surface; and, b. coating said mixture on ice, snow or other cold surface.

8. The process of claim 7 wherein said coating step is with a stream of the solution.

9. The process of claim 7 wherein said coating step is a spraying of the solution.

10. The process of claim 7 wherein said coating step is with a container with an adjustable nozzle to control the definition of spray.

11. The process of claim 7 wherein said gelling agent is an organic gelatin.

12. The process of claim 7 wherein said gelling agent is a synthetic organic or inorganic gelling chemical.

* * * * *